United States Patent [19]

Corley

[11] 4,437,267

[45] Mar. 20, 1984

[54] SINGLE PASS SIZING TOOL AND MACHINE INCLUDING WEAR COMPENSATION MEANS

[75] Inventor: William G. Corley, Dearborn Heights, Mich.

[73] Assignee: Ex-Cell-O Corporation, Troy, Mich.

[21] Appl. No.: 351,685

[22] Filed: Feb. 24, 1982

[51] Int. Cl.[3] ..... B24B 33/00

[52] U.S. Cl. ..... 51/34 R; 51/34 H; 51/338

[58] Field of Search ..... 51/34 R, 34 H, 339, 51/340, 350, 346, 165.77, 165.88

[56] References Cited

U.S. PATENT DOCUMENTS

| | | | |
|---|---|---|---|
| 2,102,053 | 12/1937 | Batzer | 51/348 X |
| 2,741,071 | 4/1956 | Calvert | 51/34 C |
| 2,757,488 | 8/1956 | Greenberg | 51/340 X |
| 2,787,865 | 4/1957 | Gross | 51/34 C |
| 2,845,752 | 8/1958 | Calvert | 51/34 R |
| 2,870,577 | 1/1959 | Seborg | 51/34 H |
| 3,286,409 | 11/1966 | Greenberg | 51/34 R X |
| 4,206,572 | 6/1980 | Delehonte | 51/34 H |

*Primary Examiner*—E. R. Kazenske
*Assistant Examiner*—Willmon Fridie, Jr.
*Attorney, Agent, or Firm*—Edward J. Timmer

[57] ABSTRACT

A bore sizing machine of the type having a plurality of single pass abrading tools with a preset single pass cutting diameter progressively increasing from one tool to the next is provided. Each abrading tool includes a wear compensation shaft threadably coupled at one end to an axially slidable tapered arbor inside the tool body and driven at the other end outside the tool body by a stepping motor or other drive device to slide the arbor relative to abrading device carried on the arbor or tool body to return a worn tool diameter to the original preset single pass cutting diameter, preferably in response to a signal from wear sensing and signaling devices.

8 Claims, 4 Drawing Figures

SINGLE PASS SIZING TOOL AND MACHINE INCLUDING WEAR COMPENSATION MEANS

FIELD OF THE INVENTION

The present invention relates to a machine for sizing a workpiece bore to a given close tolerance diameter using successive single pass abrading tools having different fixed working diameters and to wear compensation means associated with the machine and tools for returning a worn tool diameter to the original single pass diameter.

BACKGROUND OF THE INVENTION

Sizing of a workpiece bore in small increments with a plurality of abrading tools of different fixed diameter is shown in U.S. Pat. No. 4,291,504 issued Sept. 29, 1981 of common assignee herewith. In this sizing process, each tool diameter is initially adjusted to a preselected fixed diameter increasing from one tool to the next and the workpiece bore is exposed successively to the increasing diameter tools. Each tool is passed through the bore from one end to the other and then withdrawn by reverse movement to constitute a single pass working cycle. Stock removal capability per cycle is comparatively low and is usually limited to a few thousandths of an inch. Although a single tool single pass system may be employed, it is common when stock removal requirements exceed the capability of a single tool single pass operation to provide multiple spindles and tools successively removing less stock with finer grit size and larger diameter abrading tools, thereby qualifying the bore for the next single pass tool. This technique is advantageous for sizing bores to extremely narrow limits of size, roundness and straightness.

The tool employed typically includes an adjustable abrading sleeve or multiple stones engaged by a tapered arbor. In the past, the tool has been preset to the fixed single pass diameter by manually turning threaded nuts which slide the abrading sleeve or stones and arbor relative to one another; i.e. as shown in the Fitzpatrick U.S. Pat. No. 4,173,852 issued Nov. 13, 1979 and copending application U.S. Ser. No. 305,008 entitled "Fixed Diameter Single Pass Abrasive Tool with Multi-Layer Inserts" filed in the name of the present inventor and of common assigne herewith. This same manual adjustment arrangement has also been employed in adjustment of the abrading tool to compensate for wear after long machining runs often comprising several thousand parts. Wear of individual tools is sensed by so-called gage plugs such as those described in the previously referenced U.S. Pat. No. 4,291,504. Another abrading tool employing manual tool diameter adjustment by threaded nuts is described in U.S. Pat. No. 4,199,903 issued Apr. 28, 1980.

Prior art patents disclose expandable cutting tools for applications other than incremental sizing of bores, in particular for honing, reaming and lapping. For example, the Roebbel and Rogers U.S. Pat. No. 1,828,074 describes a honing or lapping tool in which an adjusting rod extending through a hollow tapered arbor pulls an external sleeve against the stones and slides them along the tapered arbor for diameter expansion. The adjusting rod is actuated manually by a threaded nut and collar. The abrading members of the tool of the Beard U.S. Pat. No. 1,874,856 are expanded or contracted in diameter by a manually-operable threaded nut/collar arrangement at opposite ends of the abrading members. A somewhat similar arrangement is illustrated in the Sims U.S. Pat. No. 1,960,555. A simple collar arrangement is provided in the Speck U.S. Pat. No. 2,694,277 for adjusting the diameter of the abrading sleeve. Adjustment is effected by striking one of the positioning collars located at opposite ends of the abrading sleeve.

A multiple spindle honing machine is shown in Greenburg U.S. Pat. Nos. 2,757,488 and 3,286,409. In these patents, the honing stones are carried at lower ends of hollow shanks. The upper ends of the shanks are attached to rotatable hollow spindles which in turn are journaled on a reciprocable machine head. Hone expander rods include conical cams at their lower ends to engage the honing stones for expansion purposes and extend through the shanks and spindles into the machine head. Each expander rod terminates in a threaded end coupled to threaded nut journaled in the machine head and having a flange in the form of a worm wheel. A power actuator mechanism including a pair of electric motors and worm gear is provided for driving the worm wheel to translate the expander for hone diameter adjustment. U.S. Pat. Nos. 2,787,865 and 2,787,866 issued to Gross also disclose power actuator means for actuating a hone expander rod. And, the Seborg U.S. Pat. No. 2,870,577 describes a long expander rod which carries a lateral pin with the pin riding in a helical inner groove on a sleeve member. A rack bar meshes with a gear on the sleeve member to rotate the latter, causing the hone expander rod pin to ride up or down in the helical groove and raising or lowering the expander rod.

The Fitzpatrick U.S. Pat. No. 4,187,644 discloses another multiple spindle honing machine in which hydraulic feed cylinders are mounted on a reciprocable spindle head with a connector rod operatively connecting one of the feed cylinders with a respective honing tool. Each connector rod comprises first and second threaded members secured together by a threaded coupling. The rods extend from the feed cylinders through a hollow drive member and have a lower end with conical cams for radially expanding the honing stones. The feed cylinders provide initial expansion of the honing tools upon spindle head movement while a constant feed mechanism assumes expansion of all the tools at a constant rate during the honing operation. The constant feed mechanism includes a gear rack which meshes with the second threaded member of the connector. Machine operation is automatically terminated by a switch mechanism when excessive honing stone wear is sensed. Similarly, the honing tools are auomatically collapsed by switch means when a gauge plug detects that the proper bore size has been reached. U.S. Pat. Nos. 2,741,071 and 2,845,752 issued to Calvert and U.S. Pat. No. 2,797,531 issued to Seborg also disclose hydraulically actuated hone expander rods.

SUMMARY OF THE INVENTION

It is an object of the present invention to provide a bore sizing machine of the type described having a plurality of single pass abrading tools wherein improved wear compensation means is provided for adjusting the single pass tool diameter to compensate for wear after long machining runs.

It is another object of the invention to provide such tool wear compensation means which is capable of independently adjusting the single pass tool diameter of multiple abrading tools having increasing diameter from one tool to the next.

It is still another object of the invention to provide such wear compensation means for the machine and tools which is adapted to automatic machine control in response to gaging means associated with the tools.

In a typical embodiment of the invention, the sizing machine includes one or more abrading tools operatively coupled to a respective machine spindle. Each tool includes an open-ended tool body fixed to a spindle at one end and an arbor slidable axially inside the tool body with the arbor having a threaded end adjacent the spindle and a tapered end adjacent the other open end of the tool body. Means are provided for preventing rotation of the arbor relative to the tool body while permitting axial sliding movement thereof. Abrading means is carried by at least one of the tool body and arbor and is expandable radially in response to sliding of the arbor in the tool body so as to adjust the single pass tool diameter. Wear compensation means is included in the form of a wear compensation shaft having a first threaded end extending into the tool body open end adjacent the spindle and coupled to the threaded arbor end and having a second driven end extending through a passage in the spindle for operative connection to drive means, preferably stepping motor means for rotating the wear compensation shaft in response to a signal from tool gage means indicating that the abrading means is worn out of the diametrical limits. Preferably, the wear compensation shaft includes an intermediate radial flange which is rotatably mounted in the open tool body end by bushing means seated in the tool body. Each tool may be provided with the wear compensation shaft rotatably mounted therein for purposes of individual tool diameter adjustment. The wear compensation shafts may be driven independently by a plurality of drive means or by common drive means via suitable gearing for selective actuation of each shaft.

DESCRIPTION OF PREFERRED EMBODIMENTS

Figure 1:
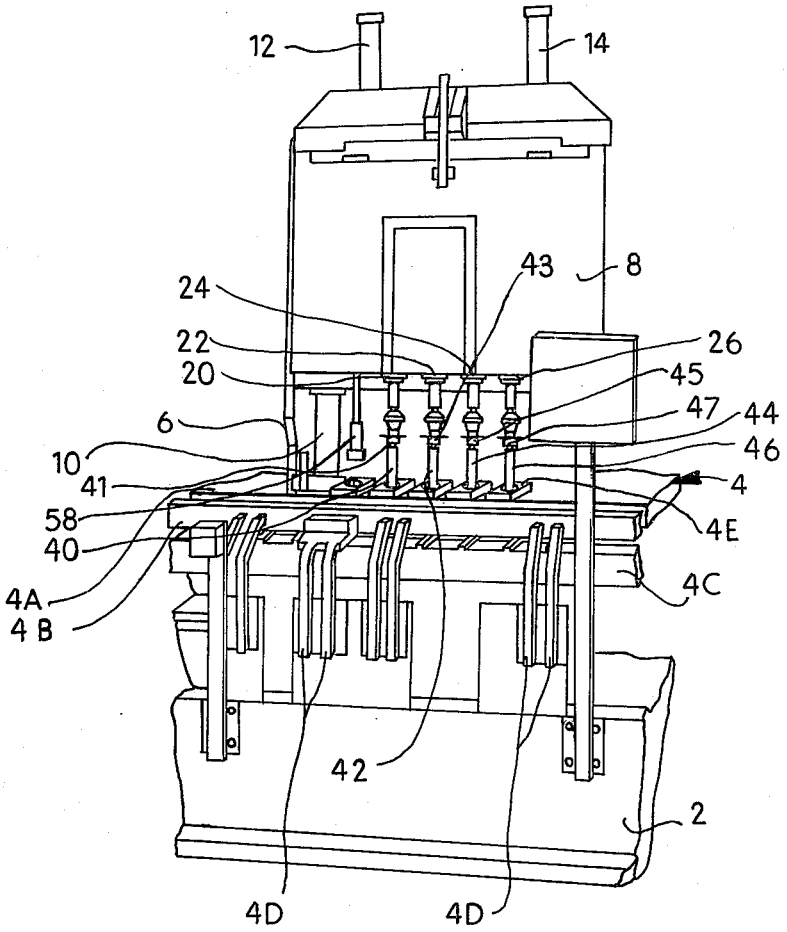
FIG. 1 is a partial perspective view of a bore sizing machine to which the invention is directed including a plurality of single pass abrading tools of increasing diameter from left to right in the figure.

A vertical bore sizing machine to which the present invention is applicable is illustrated in FIG. 1 as comprising a base frame 2 on which workpiece fixturing means 4 is mounted and a vertical frame 6 on which a machine head 8 is mounted for reciprocating movement toward and away from the workpiece fixturing means. The machine head is reciprocated on guide rails only one (rail 10) of which is shown by a pair of hydraulic cylinders 12 and 14 supported on vertical frame 6. This type of arrangement for reciprocating a machine head is well known in the art. The machine has four spindles 20, 22, 24, 26 journaled therein for rotation by individual electric or other known spindle motors (not shown) through a belt and pulley arrangement. For example, as shown more clearly in FIG. 4, a pulley 30 is fixed to hollow drive shaft 32 and keyed therewith. The drive shaft in turn is fixed to spindle housing 36 by weldments or other suitable fastening means. Of course, other spindle driving mechanisms known to those skilled in the art may be employed.

Figure 4:
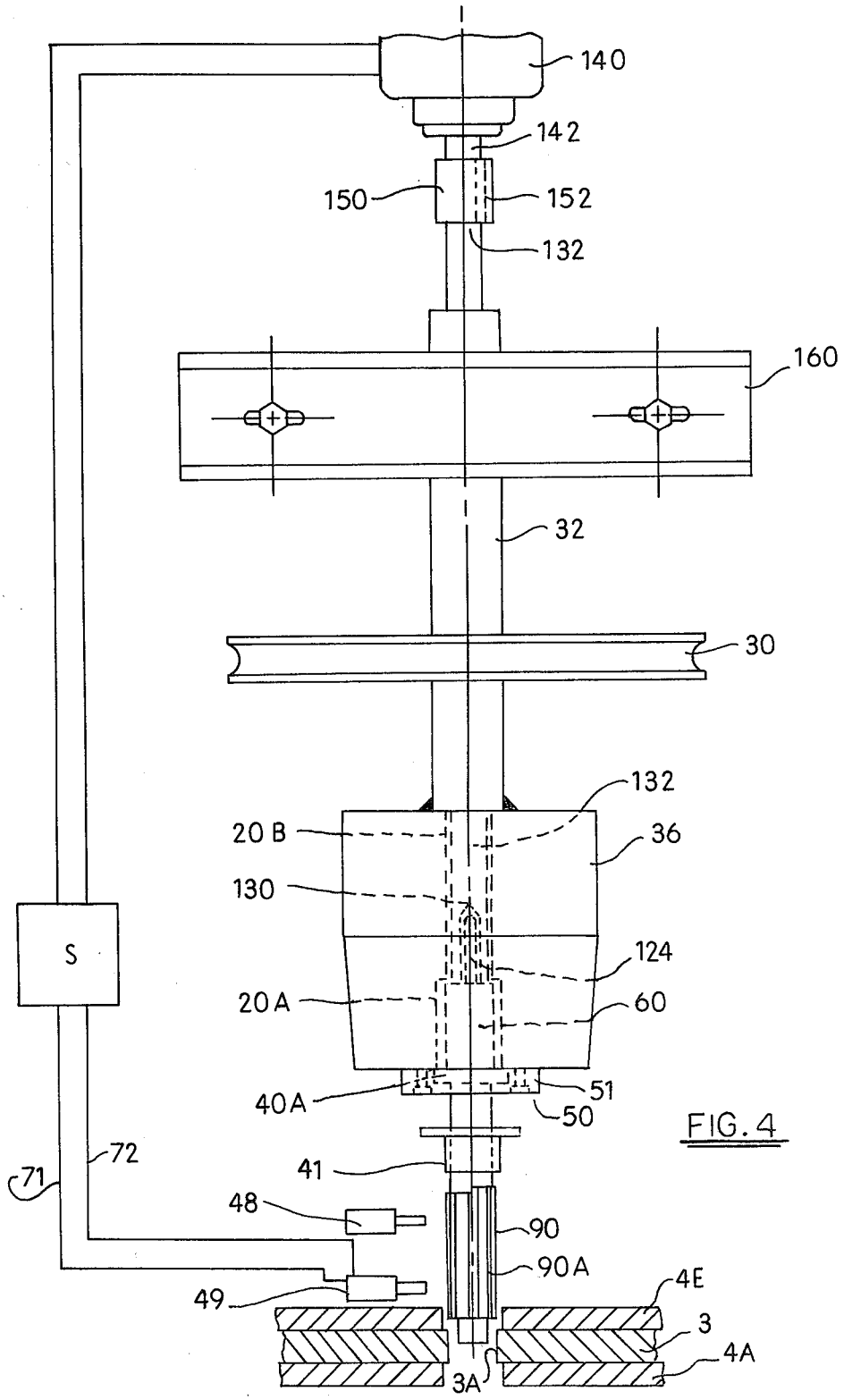
FIG. 4 is a somewhat schematic front elevation of the abrading tool mounted on the machine spindle with associated driving components and with the gage plug.

Four abrading tools 40, 42, 44, 46 are coupled to the spindles 20, 22, 24, 26 by means of radial flanges thereon being clamped to the spindle ends for example radial flange **40*a* clamped to spindle end 20*a* by machine screws 50 and clamping plate 51, i.e., as shown in FIG. 4. Each tool is shown in FIG. 1 carrying a gage plug 41, 43, 45, 47 of the type described in the above cited U.S. Pat. No. 4,291,504, the teachings of which are incorporated herein by reference. As described in that patent the gage plugs are used to sense the size of the bore and thus whether a particular abrading tool diameter is within the proper size range. Solenoid means 48 and switch means 49** also described therein are used in combination with each gage plug to determine whether a tool diameter is undersized or not. The switch signal is fed through suitable circuitry to automatically adjust the tool diameter to its original value as described hereinafter.

An air gage plug 58 of known construction is first inserted into the workpiece bore to precheck the bore size prior to sizing by the abrading tools 40, 42, 44, 46. This precheck is useful in rejecting workpieces which are initially out of rough tolerance.

In the sizing process carried out by the machine of FIG. 1, the workpiece bores are exposed successively to abrading tools 40, 42, 44, 46 in that order, the tools being of progressively increasing single pass diameter from tool 40 to tool 46. For example, in sizing a certain connecting rod bore, the single pass diameters from tool 40 through 46 were 2.5223, 2.5233, 2.5241 and 2.5246 inches, respectively. A single pass cycle in the process comprises inserting a tool into and completely through the bore on a down stroke and then retracting the tool through the bore in the reverse direction to complete the cycle while at the same time rotating the tool. Stock removal capability per single pass is comparatively low and is usually limited to a maximum of a few thousandths of an inch. As mentioned, the abrading tools 40, 42, 44, 46 are adjusted to progressively greater tool diameter sizes to remain within the stock removal capability of each tool.

Workpiece fixturing means 4 is provided on base frame 2 to hold each workpiece with its bore **3*a* coaxially aligned relative to the abrading tool rotational axis, FIG. 4. Since the workpieces are exposed to the abrading tools in succession, it is desirable for the workpiece fixturing means to be in the form of a lift-and-carry transfer mechanism including a fixed table 4*a* and end guide 4*b* and lift-and-carry table 4*c* that is lifted into the space between the fixed table and end guide to effect the sequential transfer of a workpiece from one tool to the next. End guide 4*b* is supported on base frame 2 by multiple support arms 4*d*. This type of workpiece transfer mechanism is known to the prior art. Individual retractable upper workpiece clamps 4*e* cooperate with the fixed table 4*a* and end guide 4*b* to hold the workpieces in position therebetween during bore sizing. During sequencing of the workpieces from one tool to the next, the upper clamps 4*e*** are retracted out of the way. Of course, other known workpiece fixturing means may be employed.

Figure 2:
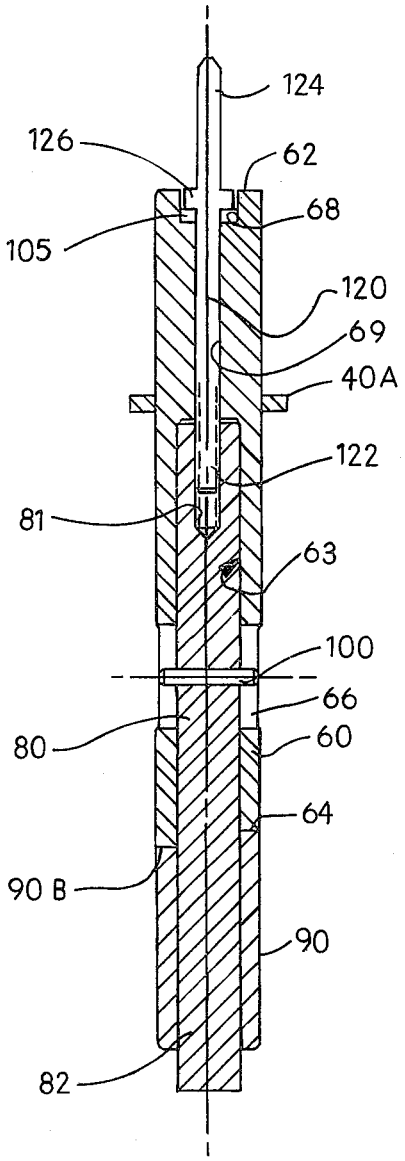
FIG. 2 is a cross-sectional view of an abrading tool of the invention.
Figure 3:
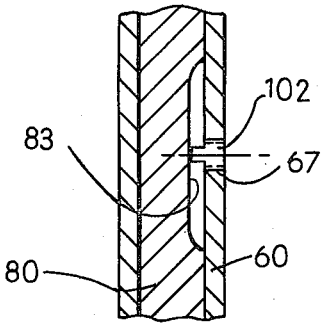
FIG. 3 is a partial cross-section of the abrading tool showing alternative means for preventing rotation of the arbor relative to the tool body.

The abrading tools 40, 42, 44, 46 have the same construction and only tool 40 will be described hereinafter with reference to FIG. 2. The tool 40 is shown as including an open-ended tool body 60 having a radial flange 40*a* near the upper open end 62 for attachment to the associated spindle 20. A clamping plate 51 is attached to the spindle by machine screws 50 and thereby fixedly attaches the tool body to the spindle as already described. The tool body includes a cylindrical bore 63 extending therethrough from one open end to the other. Slidably mounted in the bore 63 is an elongated arbor 80 having a threaded recess 81 facing the upper open end 62 of the tool body and the associated spindle 20. The arbor also includes a tapered end 82 at the opposite end extending out of the lower open annular end 64 of the tool body toward the workpiece. A slotted abrading sleeve 90 is carried on the tapered end of the arbor and is adjustable radially in size in response to axial movement of the tapered arbor end therethrough as can be appreciated. The abrading sleeve typically includes axial slots 90*a* that provide a removal path for abraded workpiece material from the bores and are plated typically with diamond or cubic boron nitride grit for quick, precise stock removal and superior surface finishes in the single pass operation. It will be noted that the abrading sleeve includes an upper annular end 90*b* that abuts and is fixed against upward axial movement by the lower annular end 64 of the tool body end 60. Although the arbor 80 must be slidable axially within the tool body bore 63, it must not rotate with the body. To this end, means in the form of a press-fit pin 100 is inserted radially through slots 66 in the tool body as shown in FIG. 2. Or a set screw 102 may be threaded into a threaded recess 67 in the tool body in an alternative arrangement as shown in FIG. 3. It is apparent in FIG. 3 that the arbor 80 includes a flat 83 against which the set screw acts to prevent arbor rotation. However, a slight space is provided between the flat and end of the set screw to permit axial sliding of the arbor.

The upper open end 62 of the tool body includes a counter bore 68 in communication with cylindrical bore 63 and in which is seated an annular bushing 105. A wear compensation shaft 120 has a first male threaded end 122 extending through the counter bore 68, intermediate cylindrical bore 69 and cylindrical bore 63 into threadable engagement with the threaded recess 81 of arbor 80 as shown most clearly in FIG. 2. The opposite driven end 124 extends out of the upper open tool body end 62 into the spindle 20, FIG. 4. The driven end 124 is square or otherwise shaped to complementary mate with a receiving-passage 130 in the drive shaft 132 from a stepping motor 140. Intermediate the ends 122 and 124 is a radial flange 126 which seats on the bushing 105 in the counterbore 68.

As shown in FIG. 4, spindle 20 includes a lower passage 20*a* adapted to receive the upper open end 62 of the tool body including portions extending to abutting radial flange 40*a* as well as the driven end 124 of the wear compensation shaft. The spindle also includes an upper passage 20*b* above and in communication with lower passage 20*a*. The hollow drive spindle drive shaft 32 is welded to the spindle housing as shown. The wear compensation drive shaft 132 extends through the hollow shaft 32 and spindle passage 20*b* into the spindle passage 20*a*. Shaped recess 130 is provided in the end of wear compensation drive shaft to receive and be coupled to the complementary shaped driven end 124 of the wear compensation shaft. The drive shaft 132 extends upwardly through hollow spindle drive shaft 32 and is coupled at its upper end to the output shaft 142 of a conventional stepping motor 140 by means of coupling member 150 having key 152. The stepping motor 140 may be supported on vertical frame 6 or on pillow block 160 fastened to frame 6 as desired. It may be possible to mount the stepping motor directly on or in the spindle housing 36. Conventional precision stepping motors of the pneumatic, hydraulic or electrical type may be employed to actuate the wear compensation drive shaft 132 and in turn wear compensation shaft 120 to axially slide the arbor 80 relative to the abrading sleeve 90 to adjust the single pass diameter thereof to compensate for wear. It will be appreciated that small magnitude, precision movements are used for tool diameter adjustment and the stepping motor will be selected accordingly.

Of course, those skilled in the art will appreciate that the gage plug and switch means described in the U.S. Pat. No. 4,291,504 previously incorporated by reference can be used with suitable known circuitry to actuate the stepping motor 140 when an abrading tool exhibits a single pass diameter worn out of the proper size limit. The machine could then automatically adjust any worn abrading tool individually to return the diameter to the original preset single pass diameter. For example, electrical output leads 71 and 72 from the gage plug switch 49 could be coupled to a known stepping directional switch S which actuates the motor 140 to rotate output shaft 142 in one direction or the other depending on the gaged tool diameter. It will be appreciated that this is a significant advance over the currently used manual wear compensation technique.

Although certain preferred embodiments and features have been described herein, it will be appreciated that modifications can be made thereto. For example, the abrading tools may comprise individual abrading stones mounted in slots in the tool body and expanded radially by a tapered arbor section such as described in the copending application U.S. Ser. No. 305,008 entitled "Fixed Diameter Single Pass Abrasive Tool With Multi-Layer Inserts" filed in the name of the present inventor and of common assignee herewith, the teachings of which are incorporated herein by reference. Also, instead of each wear compensation shaft being driven by its own individual stepping motor, it is envisioned that a single, common stepping motor may be employed with a suitable gear mechanism to selectively adjust a worn tool diameter to its original single pass diameter. And, the gage plugs need not be associated with each abrading tool but rather could be located after each abrading tool as a separate gaging station alternating with the abrading stations. It will be further understood by those skilled in the art that other changes, additions and the like in the form and detail of the illustrated embodiments may be made without departing from the spirit and scope of the invention.

I claim:

1. A single pass abrasive tool attachable to a hollow machine spindle means and useful for sizing a workpiece bore to a given diameter comprising:

a hollow tool body having a first open end adapted for insertion inside said machine spindle means and a second open end facing the workpiece bore, an arbor member slidable axially in the tool body and having a threaded end adjacent the first open end of said tool body and a tapered end adjacent said second end, abrading means carried by at least one of said tool body and arbor member having a fixed single pass cutting diameter selected to produce said given diameter during a single pass axial and rotary movement through the bore, said abrading means being radially movable with respect to the tool body in response to axial movement of the arbor member for wear compensation purposes, and a wear compensation shaft rotatable in said tool body, said shaft having a first threaded end extending into the first open end of said tool body into threaded engagement with said threaded arbor end inside said tool body and having a second driven end extending out of said first open end inside said machine spindle means for rotation therein by shaft drive means, whereby axial sliding movement can be imparted to said arbor member by rotating said wear compensation shaft to reset a worn diameter of said abrading means to the original single pass cutting diameter.

2. The abrasive tool of claim 1 wherein said wear compensation shaft includes an annular flange intermediate the first and second ends with the flange seated for rotation in the first open end of the tool body.

3. The abrasive tool of claim 2 wherein annular bushing means is disposed in a counterbore in said first open end and said flange seats on said bushing means.

4. The abrasive tool of claim 1 wherein means are associated with the tool body and arbor member for preventing rotation of said arbor member relative to said tool body while permitting sliding thereof axially in said tool body.

5. The abrasive tool of claim 1 wherein the threaded end of said arbor member comprises a threaded recess and the first threaded end of said wear compensation shaft comprises an externally threaded shaft.

6. A bore sizing machine comprising a plurality of rotatable and reciprocable spindle means, (b) a plurality of single pass abrading tools attached to a respective one of the spindle means with the tools having a progressively increasing preset fixed single pass diameter from one tool to the next so that a workpiece bore can be sized in small increments by exposing the bore to the tools in succession, said abrading tools comprising a hollow tool body having a first open end received inside an operatively associated spindle means and a second end facing the associated workpiece bore, an arbor member moveable axially in the tool body and having a threaded end adjacent the first open end of said tool body and a tapered end adjacent the second end thereof, abrading means carried by at least one of said tool body and arbor member having a fixed single pass cutting diameter selected to produce said given diameter bore during a single pass axial and rotary movement through the bore, said abrading means being radially movable with respect to the tool body in response to axial movement of said arbor member, and a wear compensation shaft rotatable in the tool body, said shaft having a first threaded end extending into said first open end in threaded engagement inside said tool body with said threaded arbor end and having a second driven end extending out of said first open end inside said spindle means, (c) said spindle means each including a bore for receiving the first open end of said tool body and including shaft drive means independently rotatable inside each spindle means drivingly coupled to the driven end of the wear compensation shaft of the attached abrading tool, (d) a plurality of wear sensing means for determining when each abrading tool exhibits a single pass tool diameter incapable of producing said given diameter, including signal generating means responsive to said sensing means for producing a signal that tool diameter adjustment is needed, (e) means for rotating each shaft drive means in response to the signal from said signal generating means, whereby axial movement can be imparted to each arbor member to reset an individual worn tool diameter to the original single pass diameter, and (f) transfer means for moving each workpiece from one tool to the next larger tool in succession to size the workpiece bore in small increments.

7. The machine of claim 6 wherein the rotating means comprises a plurality of stepping motors having output shafts coupled to said drive shaft means.

8. The machine of claim 6 wherein the wear compensation shaft of each abrading tool includes a radial flange intermediate the first and second ends and the first open end of each tool body includes a counterbore and an annular bushing means in the counterbore and on which the radial flange is seated for rotation.

* * * * *